US006756967B2

(12) United States Patent
Onodera et al.

(10) Patent No.: US 6,756,967 B2
(45) **Date of Patent: *Jun. 29, 2004**

(54) MANUAL INPUT DEVICE IMPROVED IN OPERATABILITY AND MULTIFUNCTIONALITY, AND VEHICLE-MOUNTED CONTROL DEVICE USING IT

(75) Inventors: Mikio Onodera, Miyagi-ken (JP); Hidetaka Numata, Miyagi-ken (JP); Kenichi Seino, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 96 days.

This patent is subject to a terminal disclaimer.

(21) Appl. No.: 10/038,002

(22) Filed: Dec. 20, 2001

(65) Prior Publication Data

US 2002/0080116 A1 Jun. 27, 2002

(30) Foreign Application Priority Data

Dec. 22, 2000 (JP) ..... 2000-391250

(51) Int. Cl.[7] ..... G09G 5/08
(52) U.S. Cl. ..... 345/161; 345/184; 345/701
(58) Field of Search ..... 345/161, 163, 345/167, 184, 701, 702

(56) References Cited

U.S. PATENT DOCUMENTS 5,187,630 A 2/1993 MacKay et al.
5,252,821 A * 10/1993 Sugimura ..... 250/221
5,790,101 A * 8/1998 Schoch et al. ..... 345/161
6,128,006 A * 10/2000 Rosenberg et al. ..... 345/163
6,158,136 A 12/2000 Götz et al.
2002/0080115 A1 * 6/2002 Onodera et al. ..... 345/161

FOREIGN PATENT DOCUMENTS

DE 197 12 048 A1 3/1997
DE 198 32 677 A1 7/1998

* cited by examiner

*Primary Examiner*—Regina Liang
(74) *Attorney, Agent, or Firm*—Brinks Hofer Gilson & Lione

(57) ABSTRACT

A manual input device has a configuration consisting of a case, a joystick type knob and a rotary knob concentrically arranged over the top face of the case, one force feedback actuator for loading these knobs with external forces, a control unit for controlling the force feedback actuator, first and second power transmission mechanisms for individually transmitting the drive power of the force feedback actuator to the knobs, first and second detecting devices for individually detecting manipulated states of the knobs, and a push-button switch for finalizing signals set in the joystick type knob. A vehicle-mounted device control unit has a configuration consisting of the manual input device built into a case, on the top face of which are arranged the joystick type knob and the rotary knob provided for the manual input device, a clutch change-over switch, and push-button switches for selection of appliances.

9 Claims, 11 Drawing Sheets

MANUAL INPUT DEVICE IMPROVED IN OPERATABILITY AND MULTIFUNCTIONALITY, AND VEHICLE-MOUNTED CONTROL DEVICE USING IT

BACKGROUND OF THE INVENTION

1. Field of the Invention

The present invention relates to a manual input device with a force feedback function and a vehicle-mounted control device using it, and more particularly to technology for multifunctionalization of their input means and consolidation of those multiple functions.

2. Description of the Prior Art

Already according to the prior art, there are known manual input devices with a force feedback function input means whose knob is enabled to cause the operator to sense resistance and provided with a thrust according to the quantity and direction of its manipulation to ensure its accurate manipulation by enabling the operator to well feel its reaction to the manipulation.

FIG. 12 illustrates a known example of manual input device of this kind. This manual input device consists of a rotary knob 101, a detecting means 102 for detecting the quantity and direction of the rotation of the rotary knob 101, an actuator 103 for loading the rotary knob 101 with an external force, a control unit 104 for taking in a detection signal a supplied from the detecting means 102 and generating control signals c for the actuator 103, a D/A converter 105 for digital-to-analog (D/A) conversion of the control signal c supplied from the control unit 104, and a power amplifier 106 for obtaining drive power for the actuator 103 by amplifying the control signal c converted into an analog signal by the D/A converter 105. The control unit 104 consists of a CPU 104*a* and a memory 104*b*, and in the memory 104*b* are stored control signals c matching different detection signals a in a table form. The CPU 104*a* takes in the detection signal a from the detecting means 102, reads a control signal b matching the detection signal a that has been taken in out of the memory 104*b*, and supplies it to the D/A converter 105.

As the actuator 103 is thereby driven and enabled to apply a force feedback to the rotary knob 101 matching the quantity and direction of its manipulation, this manual input device enables the operator to well feel its reaction to the manipulation and accordingly to manipulate the rotary knob 101 accurately.

Manual input devices of this kind are used as by-wire type gear shift units for vehicles and functional adjustment apparatuses for various vehicle-mounted electric appliances including the air conditioner, radio, television, CD player and car navigation system.

When used as a gear shift device, the force feedback function that the manual input device is provided with is used as a locking means for enabling the driver to sense a click in changing the shift lever from one range to another, and thereby to forbid inappropriate manipulation of the shift lever from one specific range to another, for instance from the P (parking) range to the R (reverse) range or from the D (drive) range to the second speed range. Or when used as a functional adjustment apparatus for vehicle-mounded electric appliances, the force feedback function that the manual input device is provided with would be used for facilitating fine tuning of functions by enabling the rotary knob 101 to cause the operator to sense resistance or providing an appropriate thrust to the rotary knob 101 thereby to make its manipulation lighter. Further, the detection signal a can be used as a shift signal for the transmission to enable the gear engagement of the transmission to be changed according to the range shifting of the shift lever.

While the foregoing description referred to a case in which the manual input device is equipped with a rotary knob 101, a manual input device provided with a joystick type knob swingable in two-dimensional directions in place of the rotary knob 101 and one with a lever type knob swiveling within a fixed plane are also known.

However, no manual input device provided with a plurality of knobs, each placed under force feedback control, has been proposed so far, leaving room for multifunctionalization of manual input devices and consolidation of those multiple functions.

For instance, where the manual input device shown in FIG. 12 is to be applied as a functional adjustment apparatus for vehicle-mounted devices, as there are many vehicle-mounted devices involving diverse functions to be adjusted, trying to adjust the functions of all the vehicle-mounted devices with a single rotary knob 101 would rather adversely affect the operatability and be likely to invite more errors in operation. However, if a plurality of manual input devices are arranged in parallel on a vehicle-mounted device control unit, the manual input device will occupy a greater installation space, inviting another problem of a bulky and more costly vehicle-mounted device control unit.

SUMMARY OF THE INVENTION

An object of the present invention, attempted to solve the problems noted above, is to provide a compact and low-cost manual input device improved in operatability and multifunctionality and a compact and low-cost vehicle-mounted device control unit provided with a manual input device of this kind, also improved in operatability and multifunctionality.

According to a first aspect of the invention, in order to solve the problems noted above, there is provided a manual input device comprising a plurality of concentrically arranged knobs; one force feedback actuator for loading the plurality of knobs with an external force; a plurality of power transmission mechanisms, connected between the plurality of knobs and the force feedback actuator, for individually transmitting drive power supplied from the force feedback actuator to the plurality of knobs; and a plurality of detecting means for individually detecting the manipulated states of the plurality of knobs.

Equipping the manual input device with a plurality of knobs in this way enables the plurality of knobs to be used in a differentiated manner according to the device or the function to be adjusted, resulting in improved operatability and multifunctionalization of the manual input device. The concentric arrangement of the plurality of knobs makes possible consolidation of knob installation spaces and accordingly a reduction in the size of the manual input device. Furthermore, if the configuration is such that an external force for force feedback is selectively loaded from a single force feedback actuator onto each knob via a pertinent power transmission mechanism, the configuration of the manual input device can be made more compact than where a force feedback actuator is provided for each knob, resulting in reductions in size and cost of the manual input device and accordingly in power saving.

In a manual input device according to a second aspect of the invention, as the plurality of knobs in the first means for solving the problems, a joystick type knob and a rotary knob are concentrically provided.

Equipping the manual input device in this way with two kinds of knobs, manipulated differently from each other, prevents one kind of knob from being mistaken for the other kind of knob. Therefore, wrong manipulation of knobs is avoided, resulting in improved operatability of the manual input device. Furthermore, because a joystick type knob permits adjustment of multiple functions with a single knob, the manual input device can be multifunctionalized with a small number of knobs.

In a manual input device according to a third aspect of the invention, as each of the power transmission mechanisms in the first means for solving the problems, there are provided a clutch, a clutch change-over switch and a clutch change-over actuator operated by the switch.

Equipping as each of the power transmission mechanisms a clutch, a clutch change-over switch and a clutch change-over actuator operated by the switch in this way makes it possible to switch the power transmission path from the force feedback actuator to each knob by merely manipulating the clutch change-over switch, resulting in improved operatability of the manual input device.

In a manual input device according to a fourth aspect of the invention, a control unit for controlling the force feedback actuator in accordance with a signal from the plurality of detecting means is integrally provided within a case constituting the manual input device.

Providing the control unit of the force feedback actuator in this way integrally within the case constituting the manual input device eliminates the need to alter external devices, and accordingly facilitates the application of the manual input device to the external devices.

In a manual input device according to a fifth aspect of the invention, a control unit for controlling the force feedback actuator in accordance with a signal from the plurality of detecting means is provided in an external device operated with the plurality of knobs.

Providing the control unit of the force feedback actuator in this way in an external device makes the control unit dispensable for the manual input device, and therefore makes it possible to reduce the size, and accordingly the cost, of the manual input device.

In a manual input device according to a sixth aspect of the invention, as the plurality of power transmission mechanisms in the first means for solving the problems, there are at least a first power transmission mechanism for transmitting drive power from the force feedback actuator provided for one of the plurality of knobs; a second power transmission mechanism for transmitting drive power from the force feedback actuator provided for another of the plurality of knobs; a first clutch plate fitted to a drive shaft of the force feedback actuator to be slidable in an axial direction; and a clutch change-over actuator for sliding the first clutch plate, wherein the first power transmission mechanism is provided with a second clutch plate capable of being coupled to the first clutch plate, wherein the second power transmission mechanism is provided with a third clutch plate capable of being coupled to the first clutch plate, and wherein the coupling between the first clutch plate and the second clutch plate or the third clutch plate is changed over by having the clutch change-over actuator slide the first clutch plate.

Providing power transmission mechanisms in this way makes it possible to selectively give drive power from the force feedback actuator to the plurality of knobs, resulting in improved operatability of the manual input device.

In a manual input device according to a seventh aspect of the invention, in the sixth means for solving the problems, a joystick type knob is provided as one of the plurality of knobs and a rotary knob as another of the plurality of knobs.

Equipping the manual input device in this way with two kinds of knobs, manipulated differently from each other, prevents one kind of knob from being mistaken for the other kind of knob. Therefore, wrong manipulation of knobs is avoided, resulting in improved operatability of the manual input device. Furthermore, because a joystick type knob permits adjustment of multiple functions with a single knob, the manual input device can be multifunctionalized with a relatively small number of knobs.

In a manual input device according to an eighth aspect of the invention, as the plurality of knobs in the seventh means for solving the problems, the joystick type knob and the rotary knob are concentrically disposed.

Arrangement of knobs in this way makes possible consolidation of knob installation spaces and accordingly a reduction in the size of the manual input device.

According to the invention, there is also provided a vehicle-mounted device control unit having an electric appliance selection switch for selecting an electric appliance whose function is to be adjusted and a manual input device for adjusting a function possessed by the electric appliance selected by the selection switch, wherein the manual input device has a plurality of knobs arranged concentrically, one force feedback actuator for loading external forces onto the plurality of knobs, a plurality of power transmission mechanisms, connected between the plurality of knobs and the force feedback actuator, for individually transmitting drive power supplied from the force feedback actuator to each of the plurality of knobs, and a plurality of detecting means for individually detecting manipulated states of the plurality of knobs.

Equipping the vehicle-mounted device control unit with electric appliance selection switches for selecting the electric appliance whose function is to be adjusted, functional selection switches for selecting the function to be adjusted of the electric appliance selected by the appliance selection switch, and a manual input device for adjusting the function selected by the functional selection switch in this way enables a single vehicle-mounted device control unit to centrally accomplish functional adjustment of many electric appliances, thereby facilitating the functional adjustment of various vehicle-mounted electric appliances and enhancing the safe drive performance of the vehicle. Further, if the vehicle-mounted device control unit is provided with a manual input device having a plurality of knobs, it is possible to use the plurality of knobs in a differentiated manner according to the device or the function to be adjusted, resulting in improved operatability and multifunctionalization of the vehicle-mounted device control unit. Moreover, concentric arrangement of the plurality of knobs would make possible consolidation of knob installation spaces and accordingly a reduction in the size of the vehicle-mounted device control unit. Furthermore, if the configuration is such that an external force for force feedback is selectively loaded from a single force feedback actuator onto each knob via a required power transmission mechanism, the configuration of the vehicle-mounted device control unit can be made more compact than where a force feedback actuator is provided for each knob, resulting in reductions in size and cost of the vehicle-mounted device control unit and accordingly in power saving.

DESCRIPTION OF THE PREFERRED EMBODIMENTS

Figure 1:
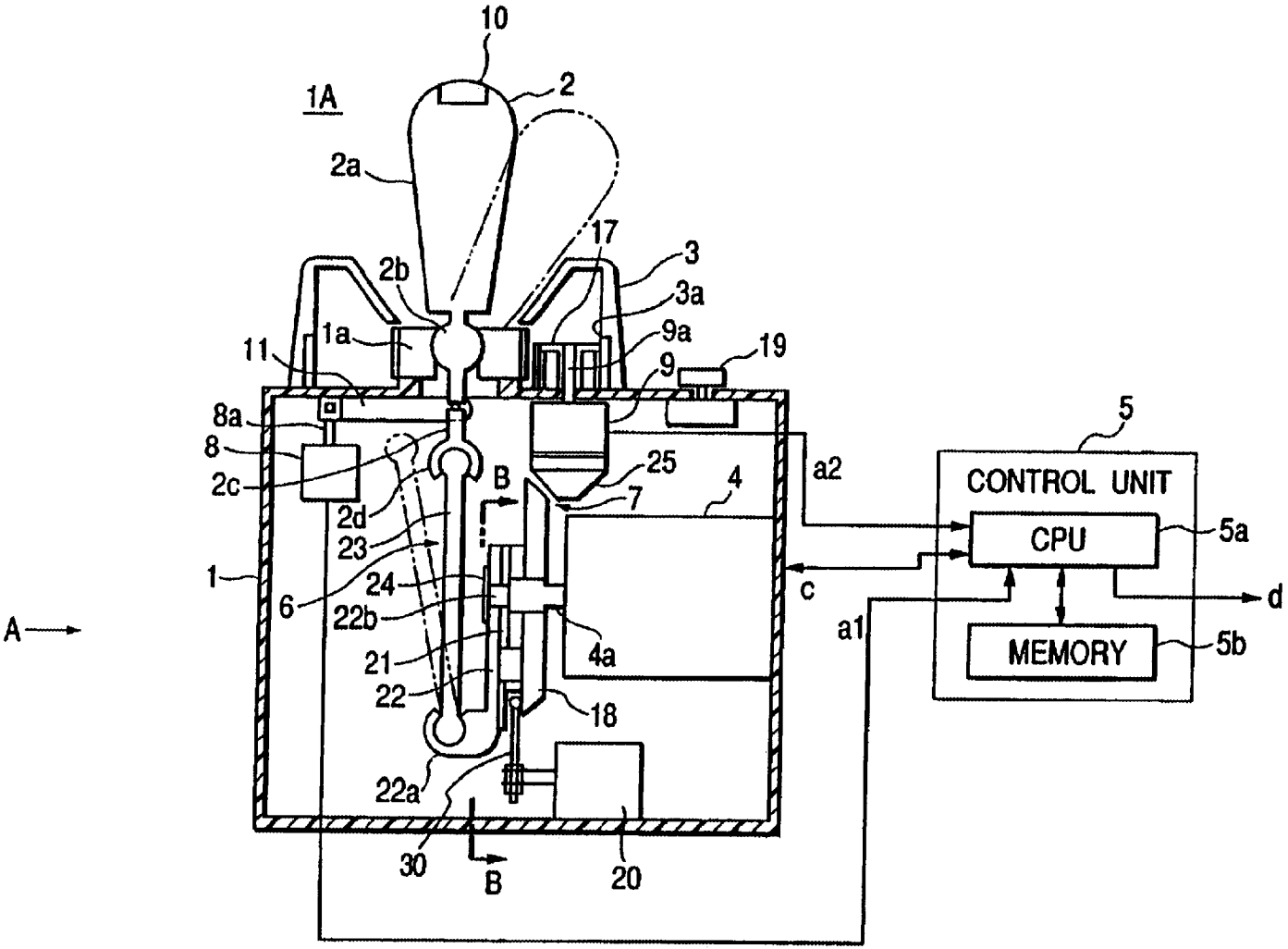
FIG. 1 is a partial section showing the states of various parts when the joystick type knob of the manual input device pertaining to a preferred embodiment of the present invention is being manipulated.
Figure 2:
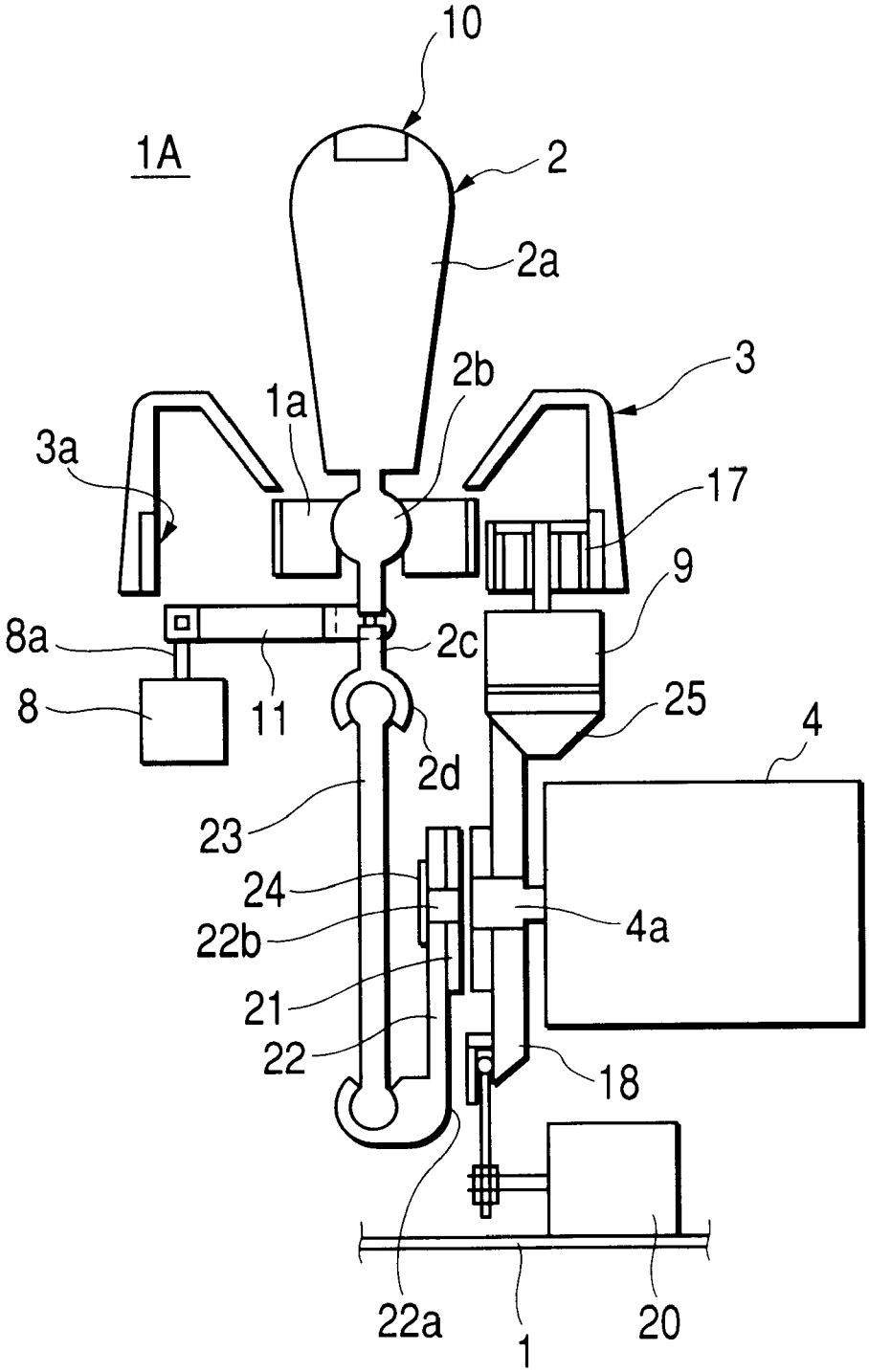
FIG. 2 is a partial section showing the states of various parts when the rotary knob of the manual input device pertaining to the embodiment of the invention is being manipulated.
Figure 3:
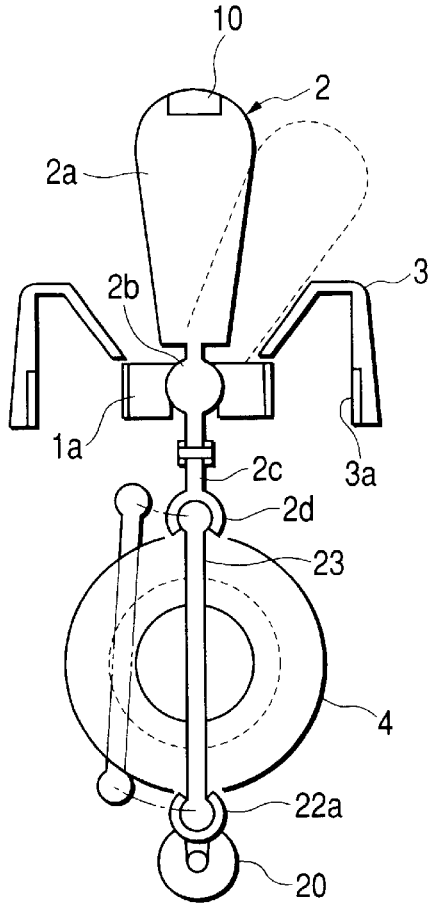
FIG. 3 is a perspective drawing in the direction of A in FIG. 1.
Figure 4:
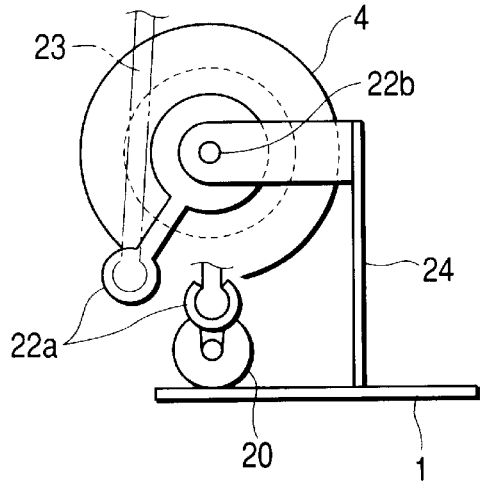
FIG. 4 is a section cut by plane B—B in FIG. 1.

An example of manual input device embodying the present invention will be described below with reference to FIG. 1 through FIG. 5. FIG. 1 is a partial section showing the states of various parts when a joystick type knob is being manipulated; FIG. 2, a section showing the states of various parts when a rotary knob is being manipulated; FIG. 3, a perspective drawing in the direction of A in FIG. 1; FIG. 4, a section cut by plane B—B in FIG. 1; and FIG. 5, a perspective drawing illustrating the configuration of a stick controller.

As shown in FIG. 1 and FIG. 2, this example of manual input device 1A consists of a case 1, a joystick type knob 2 and a rotary knob 3 concentrically arranged over the top face of the case 1, one force feedback actuator 4 for loading these knobs 2 and 3 with external forces, a control unit 5 for controlling the force feedback actuator 4, first and second power transmission mechanisms 6 and 7 for individually transmitting the drive power of the force feedback actuator 4 to the knobs 2 and 3, first and second detecting means 8 and 9 for individually detecting the manipulated states of the knobs 2 and 3, and a push-button switch 10 for finalizing signals set in the joystick type knob 2.

The joystick type knob 2 consists of a grip 2*a*, a ball 2*b*, a link 2*c* and a bearing 2*d*. By fitting the ball 2*b* to a ball bearing 1*a* provided on the top face of the case 1 and arranging the grip 2*a* outside and the link 2*c* and the bearing 2*d* inside the case 1, the joystick type knob 2 is fitted swingably to the case 1. The push-button switch 10 is fitted to part of the grip 2*a*, so that a switching signal supplied from the first detecting means 8 for determining the manipulation signal for the joystick type knob 2 can be entered into the control unit 5 by manipulating the pertinent push-button switch 10 at a prescribed timing after manipulating the grip 2*a*. To the link 2*c* is connected the manipulating lever 8*a* of the first detecting means 8. As the first detecting means 8 can be used a stick controller.

Figure 5:
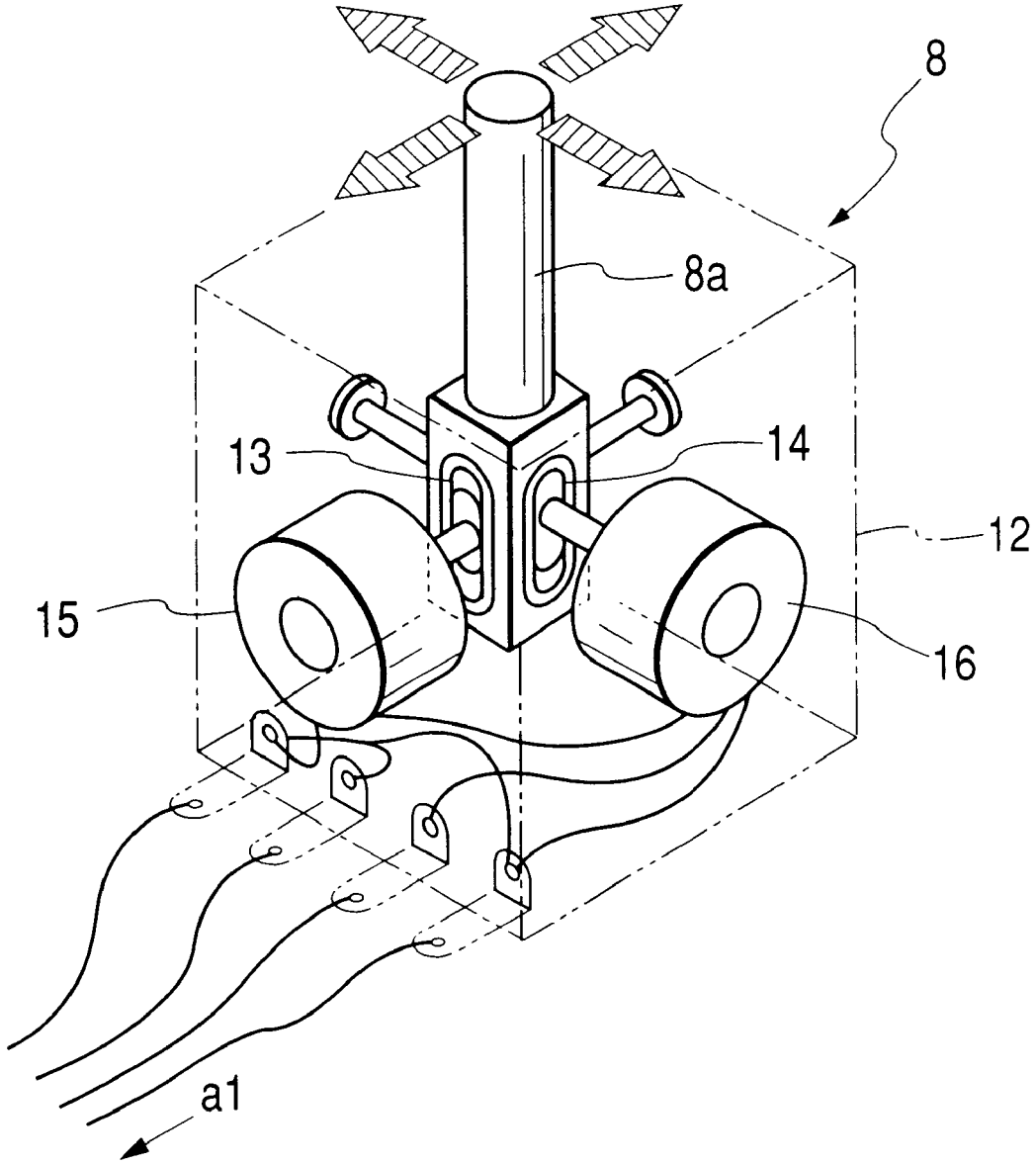
FIG. 5 is a perspective drawing illustrating the configuration of a stick controller provided in the manual input device pertaining to the embodiment of the invention.

The stick controller (the first detecting means 8), as shown in FIG. 5, consists of the manipulating lever 8*a* held swingably by a case 12, a converter 15 for converting the swinging motions of the manipulating lever 8*a* into rotating motions of two rotary members 13 and 14 arranged in directions of a right angle to each other, and two rotary encoders or variable resistors 15 and 16 for converting the quantities and directions of rotation of the two rotary members 13 and 14 into electrical signals. The encoders or variable resistors 15 and 16 supply first detection signals a1 matching the quantity and direction of the swinging of the grip 2*a* of the joystick type knob 2.

In the rotary knob 3 which is formed in a bowl shape, an internal gear 3*a* is formed on its inner surface in the circumferential direction. A pinion 17 adhered to the drive shaft 9*a* of the second detecting means 9 is engaged with the internal gear 3*a*. As the second detecting means 9, a rotary encoder or a variable resistor for converting the quantity and direction of the rotation of the rotary knob 3 into electrical signals can be used, and the second detecting means 9 supplies a second detection signal a2 matching the quantity and direction of the rotation of the rotary knob 3.

As the force feedback actuator 4, a rotary motor such as a DC motor or stepping motor, for instance, is provided. On the drive shaft 4*a* of the force feedback actuator 4 are formed splines or serrations (not shown), to which is fitted a first clutch plate 18 having in its central part spline holes or serration holes (not shown) capable of respectively engaging with them. Therefore, the first clutch plate 18 can slide in the axial direction of the drive shaft 4*a*, and rotates integrally with the drive shaft 4*a*. This first clutch plate 18 is moved forward or backward in the axial direction of the drive shaft 4*a* via a fork 30 by a clutch change-over actuator 20, which is turned on and off with the clutch change-over switch 19. As the clutch change-over actuator 20, a linear motor such as a voice coil motor or a solenoid can be used.

The first power transmission mechanism 6 for transmitting the drive power of the force feedback actuator 4 to the joystick type knob 2 consists of the first clutch plate 18, a second clutch plate 21 that is coupled to the first clutch plate 18 when the first clutch plate 18 is moved forward, a swiveling arm 22 to which the second clutch plate 21 is adhered, and a connecting rod 23 both ends of which are oscillatably held by a ball bearing 22*a* formed at the tip of the swiveling arm 22 and the bearing 2*d* formed at the lower end of the joystick type knob 2. The central axis 22*b* of the swiveling arm 22 is arranged coaxially with the drive shaft 4*a* of the force feedback actuator 4 as shown in FIG. 1 and FIG. 4, and set to a bracket 24 standing on the case 1.

On the other hand, the second power transmission mechanism 7 for transmitting the drive power of the force feedback actuator 4 to the rotary knob 3 consists of the first clutch plate 18 and a third clutch plate 25 which is fitted to the second detecting means 9 and coupled to the first clutch plate 18 when the first clutch plate 18 is moved backward.

The control unit 5 consists of a CPU 5*a* and a memory 5*b*. The memory 5*b* stores data and a program for analyzing the detection signals a1 and a2 and drive data and a drive program for the force feedback actuator 4. The CPU 5*a* takes in the detection signals a1 and a2, analyzes the detection signals a1 and a2 on the basis of the data and the program stored in the memory 5*b*, determines a control signal c matching the detection signals a1 and a2 on the basis of the data and the program stored in the memory 5*b*, and supplies it to the force feedback actuator 4. This control unit 5, connected to the electric appliance (not shown) whose function is to be adjusted with the joystick type knob 2 and the rotary knob 3, supplies a control signal d for the electric appliance matching the detection signals a1 and a2 and thereby adjusts the pertinent function of the electric appliance. Either this control unit 5 can be provided within the case 1, or a control unit provided in an external apparatus can be used instead of an internal circuit.

The control signals c of the force feedback actuator 4 are signals respectively matching different feelings which the knobs 2 and 3 would give the user. The types of the signals include "generation of vibration", "generation of impacting force" and "changing the operating force". Where the signal is for the "generation of vibration", a control signal c signifying such factors as the intensity and form of the vibration, load duration and frequency will be formed. Or where the signal is for the "generation of impacting force", a control signal c signifying such factors as the intensity and form of the impacting force and the number of loading will be formed. Further, where the signal is for "changing the operating force", a control signal c signifying such factors as the intensity and working direction of the operating force and load duration will be formed.

The operation of the manual input device 1A, which is the first preferred embodiment of the present invention, configured as described above will be described below.

When the clutch change-over switch 19 is turned on, the clutch change-over actuator 20 is started, the first clutch plate 18 moves forward, the engagement between the first clutch plate 18 and the third clutch plate 25 will be released and, at the same time, the first clutch plate 18 and the second clutch plate 21 are coupled to each other. This results in a state wherein the drive shaft 4*a* of the force feedback actuator 4 is linked only to the joystick type knob 2 via the first power transmission mechanism 6, i.e. the first clutch plate 18, the second clutch plate 21, the swiveling arm 22 and the connecting rod 23, and accordingly the drive power of the force feedback actuator 4 can be selectively transmitted to only the joystick type knob 2. The joystick type knob 2 and the swiveling arm 22 are linked by the connecting rod 23; the swiveling arm 22 is fitted to a central axis 22*a*, arranged coaxially with the drive shaft 4*a* of the force feedback actuator 4, to be able to swivel around it and, as the swiveling arm 22 is held by the bracket 24, swinging of the joystick type knob 2 would result, according to the swinging direction, in either inclination of the connecting rod 23 alone as shown in FIG. 1 or swiveling of the swiveling arm 22 around the central axis 22*a* as shown in FIG. 3 and FIG. 4, accompanied by inclination of the connecting rod 23 to keep the joystick type knob 2 linked to the drive shaft 4*a* of the force feedback actuator 4 all the time. Therefore, when the clutch change-over switch 19 is turned on, the drive power of the force feedback actuator 4 can be transmitted to the joystick type knob 2 irrespective of the swung state of the joystick type knob 2.

When the joystick type knob 2 is swung, the motion is transmitted to the manipulating lever 8*a* of the first detecting means 8 via a link 11 with the result that a first detection signal a1 matching the quantity and direction of the swinging of the joystick type knob 2 is supplied from the encoders or variable resistors 15 and 16 provided in the stick controller (first detecting means) 8. This first detection signal a1 is taken into the CPU 5*a*, and converted into a control signal c for the force feedback actuator 4 in accordance with data and a program stored in the memory 5*b*. The force feedback actuator 4 is driven by this control signal c, and loads specific external forces matching the quantity and/or direction of the swinging of the joystick type knob 2 onto the joystick type knob 2. The CPU 5*a*, in accordance with the first detection signal a1, selects the electric appliance whose function is to be adjusted and adjusts the function of the selected electric appliance.

Figure 6A:
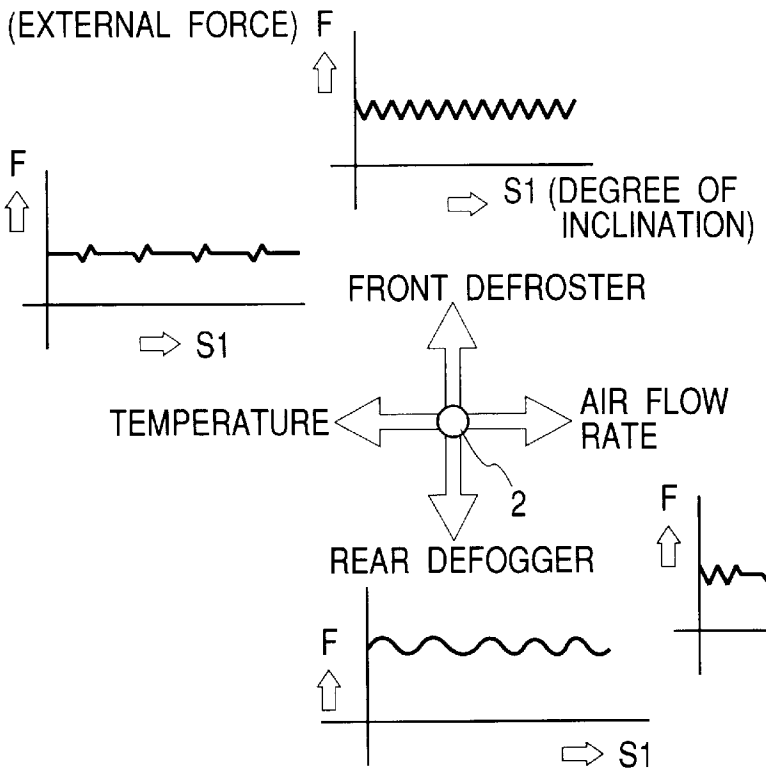
FIG. 6 illustrates the operation that takes place where a joystick type knob is applied for selection of a function and functional adjustment of a vehicle-mounted air conditioner.
Figure 6B:
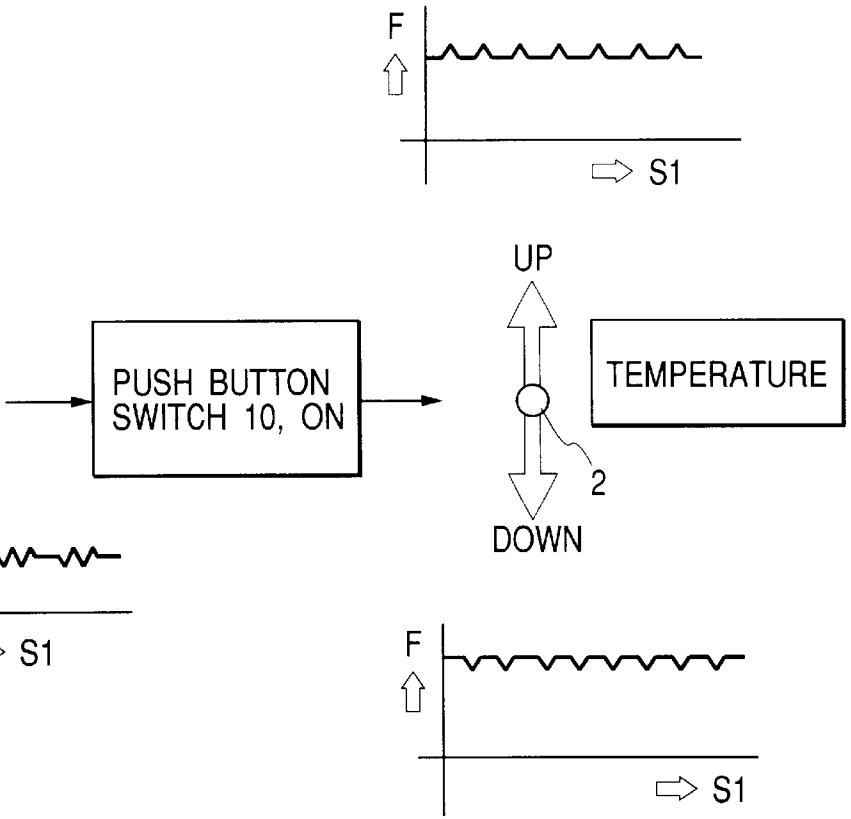

FIG. 6 illustrates the operation that takes place where the joystick type knob 2 is applied for selection of a function and functional adjustment of a vehicle-mounted air conditioner. As shown in FIG. 6(*a*), by tilting the joystick type knob 2 forward, backward, leftward or rightward from its central position, the front defroster, rear defogger, temperature adjustment or air flow rate adjustment can be selected. According to the quantity and direction of the tilting of the joystick type knob 2, the first detection signal a1 supplied from the stick controller (first detecting means) 8 changes. The CPU 5*a* takes in this first detection signal a1, drives the force feedback actuator 4 by supplying a control signal c matching the first detection signal a1, and loads an external force in the pertinent mode onto the joystick type knob 2. The four graphs shown in FIG. 6(*a*) illustrate the relationship between the tilted quantity S1 of the joystick type knob 2 and the pertinent external force F working on the joystick type knob 2. As is evident from these graphs, an external force F differing in form with the tilted direction of the joystick type knob 2 is loaded onto the joystick type knob 2. This enables the operator to know by blind touch that the joystick type knob 2 has been moved in the intended direction. In addition to that, in order to prevent the joystick type knob 2 from being operated in a wrong direction, it is also possible to cause the force feedback actuator 4 to apply to the joystick type knob 2 an external force to guide the joystick type knob 2 always in the right direction, i.e. in the example of FIG. 6 forward, backward, leftward or rightward from its central position.

The selection of the front defroster, rear defogger, temperature adjustment or air flow rate adjustment is finalized by pressing the push-button switch 10, and according to the finalized selection the CPU 5*a* is connected to the selected electric appliance. If, for instance, temperature adjustment of the air conditioner is selected by tilting the joystick type knob 2 leftward, the function of the joystick type knob 2 will then be switched to temperature adjustment of the air conditioner and, as shown in FIG. 6(*b*), the temperature can be raised by tilting the joystick type knob 2 forward or lowered by tilting it backward from its central position. In this case again, the CPU 5*a* takes in the first detection signal a1 supplied from the stick controller 8, and supplies a control signal c matching the first detection signal a1. It drives the force feedback actuator 4 with the control signal c, and loads the joystick type knob 2 with the required one of the external forces illustrated in FIG. 6(*b*). The mode of the external force when the air conditioner function is selected and that of the external mode when functional adjustment of the air conditioner may be in either the same as or different from each other in the same direction of manipulating the joystick type knob 2. FIG. 6 shows a case in which they are different. It is also possible to select the air conditioner function with the joystick type knob 2 and functional adjustment of the air conditioner with the rotary knob 3. The operation of the rotary knob 3 will be described below.

When the clutch change-over switch 19 is turned off, the clutch change-over actuator 20 is stopped, and the elasticity of an elastic member (not shown) provided in the clutch change-over actuator 20 moves back the first clutch plate 18 with the result that the engagement between the first clutch plate 18 and the second clutch plate 21 is released and the first clutch plate 18 and the third clutch plate 25 are coupled to each other. This causes the drive shaft 4*a* of the force feedback actuator 4 to be linked only to the rotary knob 3 via the second power transmission mechanism 7, i.e. the first clutch plate 18, the third clutch plate 25, the second detecting means 9, the pinion 17 and the internal gear 3*a*, resulting in a state in which the drive power of the force feedback actuator 4 can be selectively transmitted onto the rotary knob 3. As the third clutch plate 25 is adhered to the second detecting means 9 and the second detecting means 9 is adhered to the case 1, the linked state between the rotary knob 3 and the drive shaft 4*a* of the force feedback actuator 4 is maintained all the time even if the rotary knob 3 is turned. Therefore, when the clutch change-over switch 19 is turned off, the drive power of the force feedback actuator 4 can be transmitted to the rotary knob 3 irrespective of how the rotary knob 3 is turned.

When the rotary knob 3 is turned, as its motion is transmitted to the drive shaft 9*a* of the second detecting means 9 via the internal gear 3*a* and the pinion 17, a second detection signal a2 matching the quantity and direction of the rotation of the rotary knob 3 is supplied from the second detecting means 9. This second detection signal a2 is taken into the CPU 5*a*, and converted into a control signal c for the force feedback actuator 4 on the basis of the data and the program stored in the memory 5*b*. The force feedback actuator 4 is driven by this control signal c, and loads a specific external force matching the quantity and/or direction of the rotation of the rotary knob 3 onto the rotary knob 3. The CPU 5*a*, in accordance with the first detection signal a2, selects the electric appliance whose function is to be adjusted and adjusts the function of the selected electric appliance.

Figure 7:
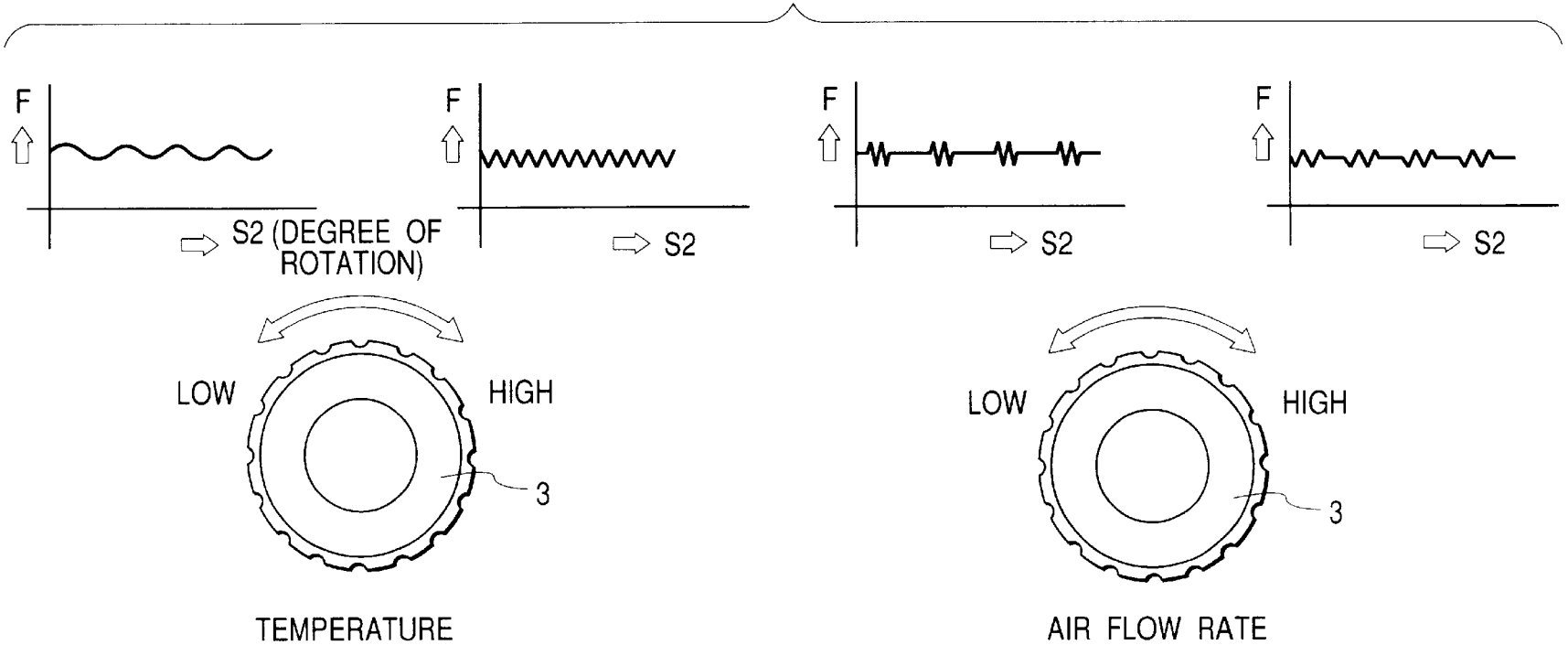
FIG. 7 illustrates the operation that takes place where a rotary knob is applied for functional adjustment of a vehicle-mounted air conditioner.

FIG. 7 illustrates the operation that takes place where the rotary knob 3 is applied for functional adjustment of a vehicle-mounted air conditioner. The air flow rate of the air conditioner can be decreased or increased by turning the rotary knob 3 leftward or rightward, respectively, from its central position. The four graphs shown in FIG. 7 illustrate the relationship between the rotated quantity S2 of the rotary knob 3 and the pertinent external force F working on the rotary knob 3. As is evident from these graphs, an external force F differing in form with the rotated direction of the rotary knob 3 is loaded onto the rotary knob 3. In this case, the CPU 5*a* supplies a control signal c matching the second detection signal a2 which varies with the quantity and direction of the rotation of the rotary knob 3 to drive the force feedback actuator 4, and thereby loads the rotary knob 3 with an external force in the required mode. This enables the operator to know by blind touch that the intended electric appliance has been controlled with the rotary knob 3. The mode of the external force when the temperature the air conditioner is to be adjusted and that of the external mode when the air flow rate of the air conditioner is to be adjusted may be in either the same as or different from each other in the same direction of manipulating the rotary knob 3. FIG. 7 shows a case in which they are different.

Whereas functional adjustment of the air conditioner has been described regarding this embodiment of the invention by way of example, the applications of the manual input device pertaining to the invention are not limited to this example but can include the control of various vehicle-mounted electric appliances including the radio, television, CD player, car navigation system, steering wheel tilting device, seat posture adjusting device, telephone, voice recognition and gear shift.

Figure 8:
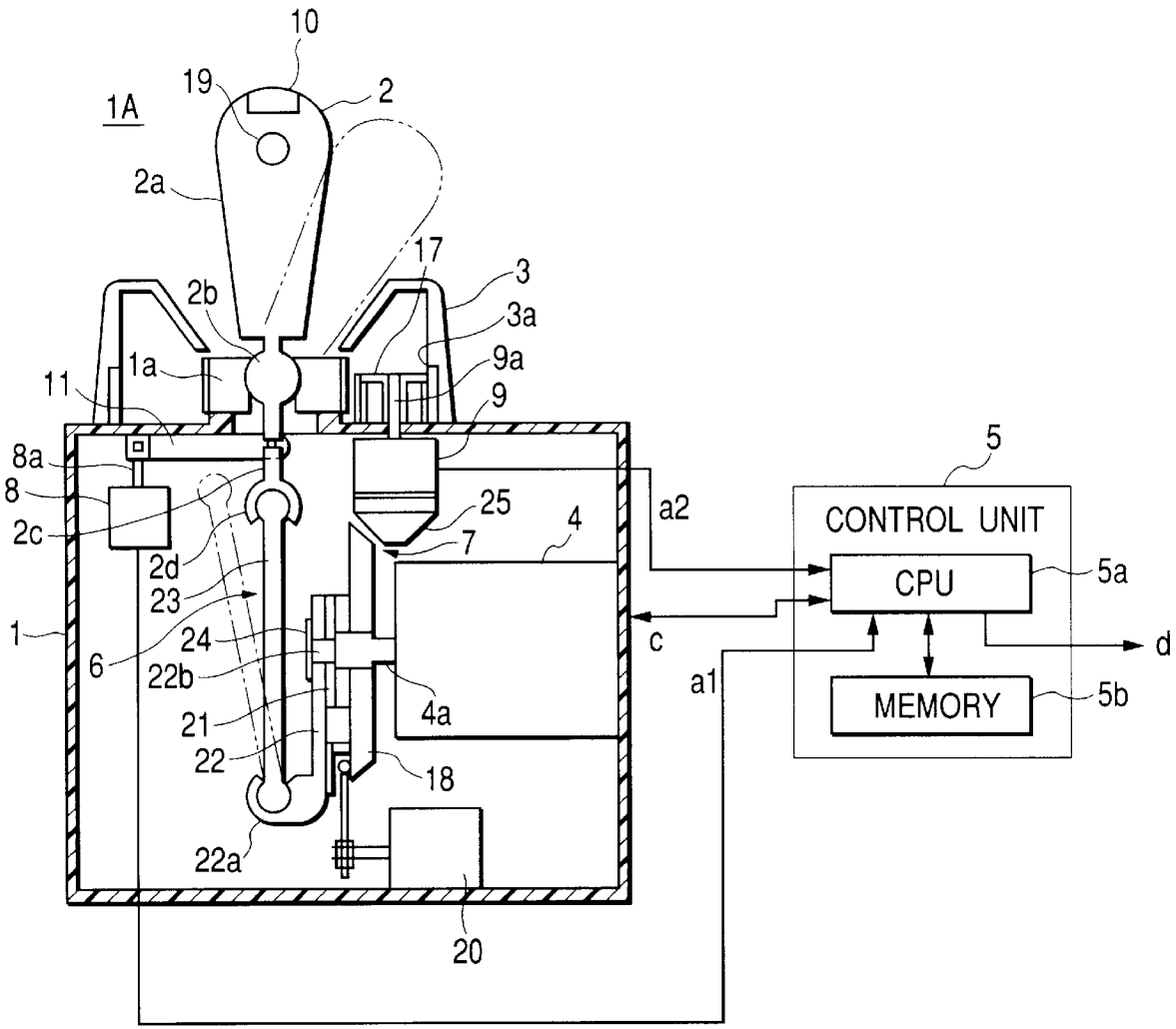
FIG. 8 is a partial section of another example of the manual input device embodying the invention.

Further, while the clutch change-over switch 19 is set in the case 1 in the embodiment described above, the clutch change-over switch 19 can as well be set in the joystick type knob 2 as shown in FIG. 8 instead of the configuration described above. In this case, the choice for use as the clutch change-over switch 19 includes, besides a push-button switch, a touch sensor or an infrared sensor which, upon detection of grabbing or attempting to grab the joystick type knob 2 by the operator, automatically drives the clutch change-over actuator 20 to move the first clutch plate 18 forward or backward.

Figure 9:
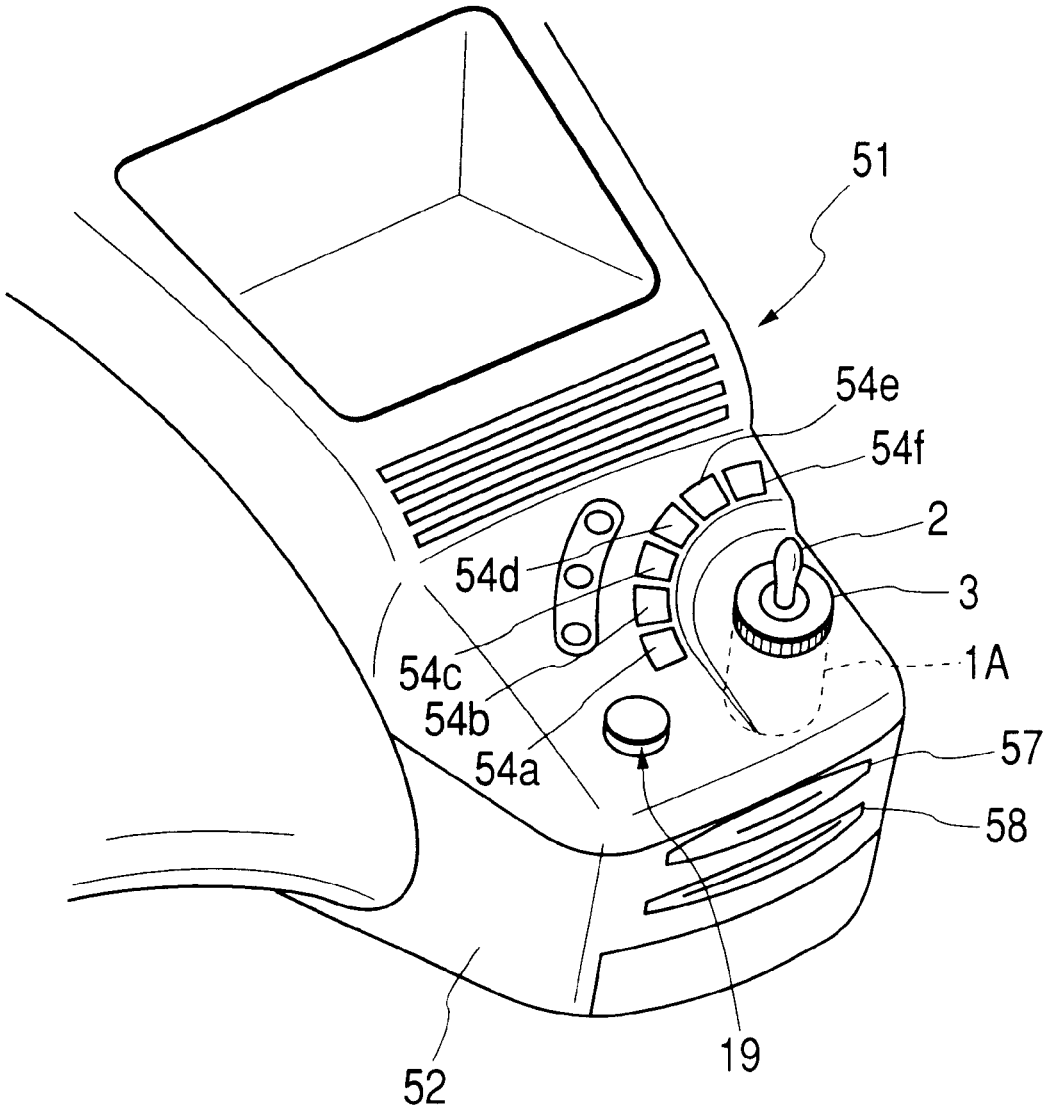
FIG. 9 is a perspective view of essential parts showing how the vehicle-mounted device control unit embodying the invention is fitted to the dashboard.
Figure 10:
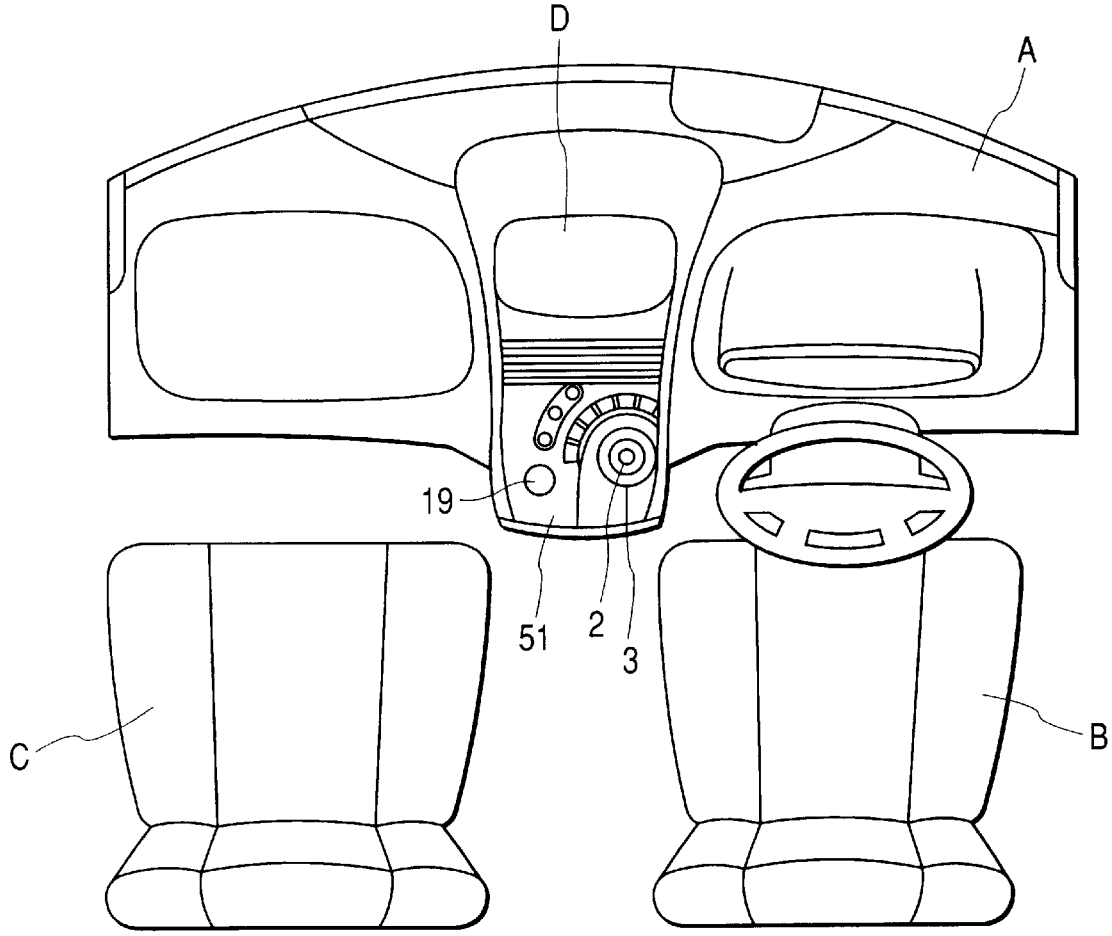
FIG. 10 is a plan of essential parts showing the interior state of a vehicle fitted with the vehicle-mounted device control unit embodying the invention.
Figure 11:
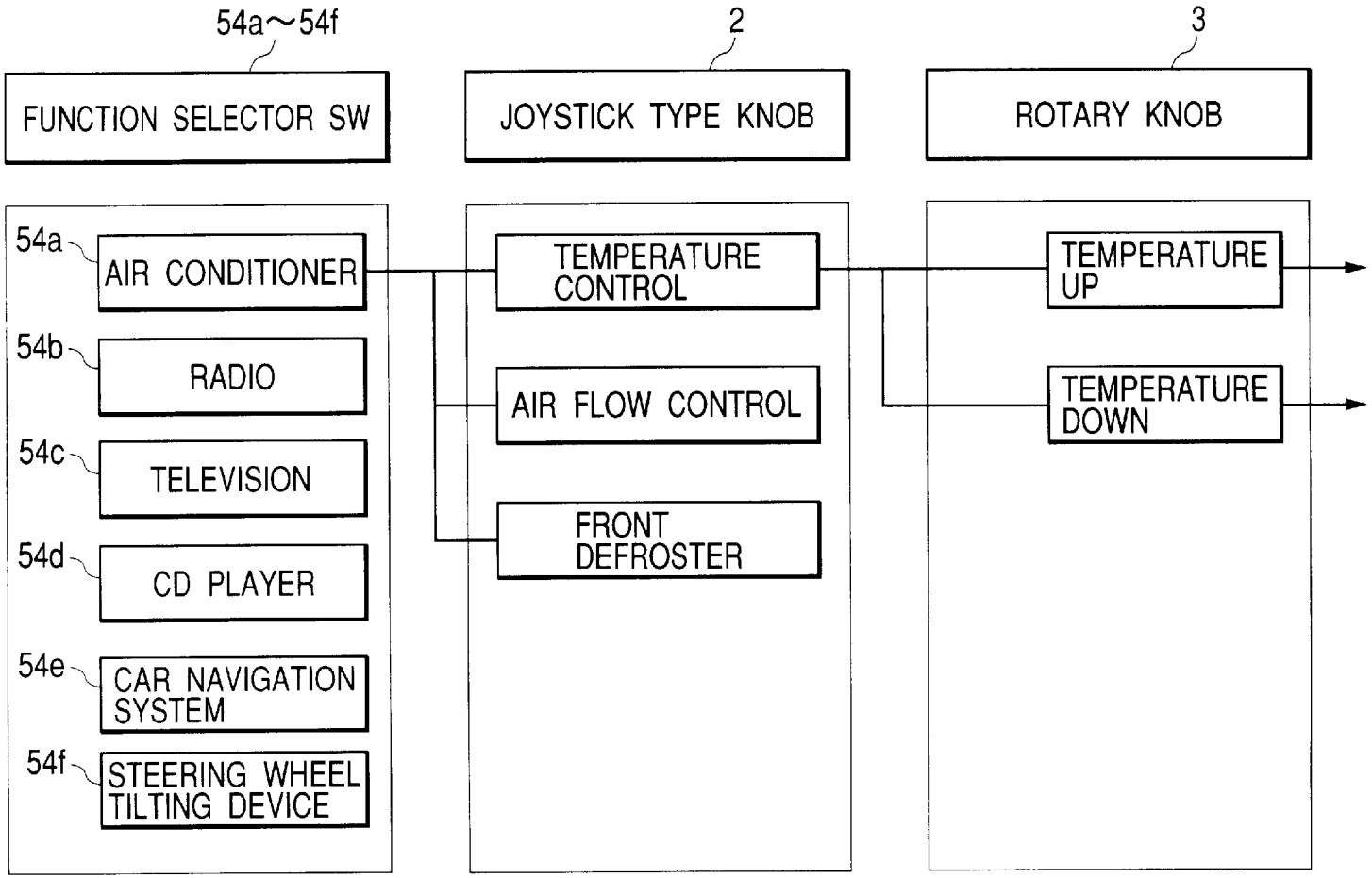
FIG. 11 is a functional block diagram of the vehicle-mounted device control unit embodying the invention.
Figure 12:
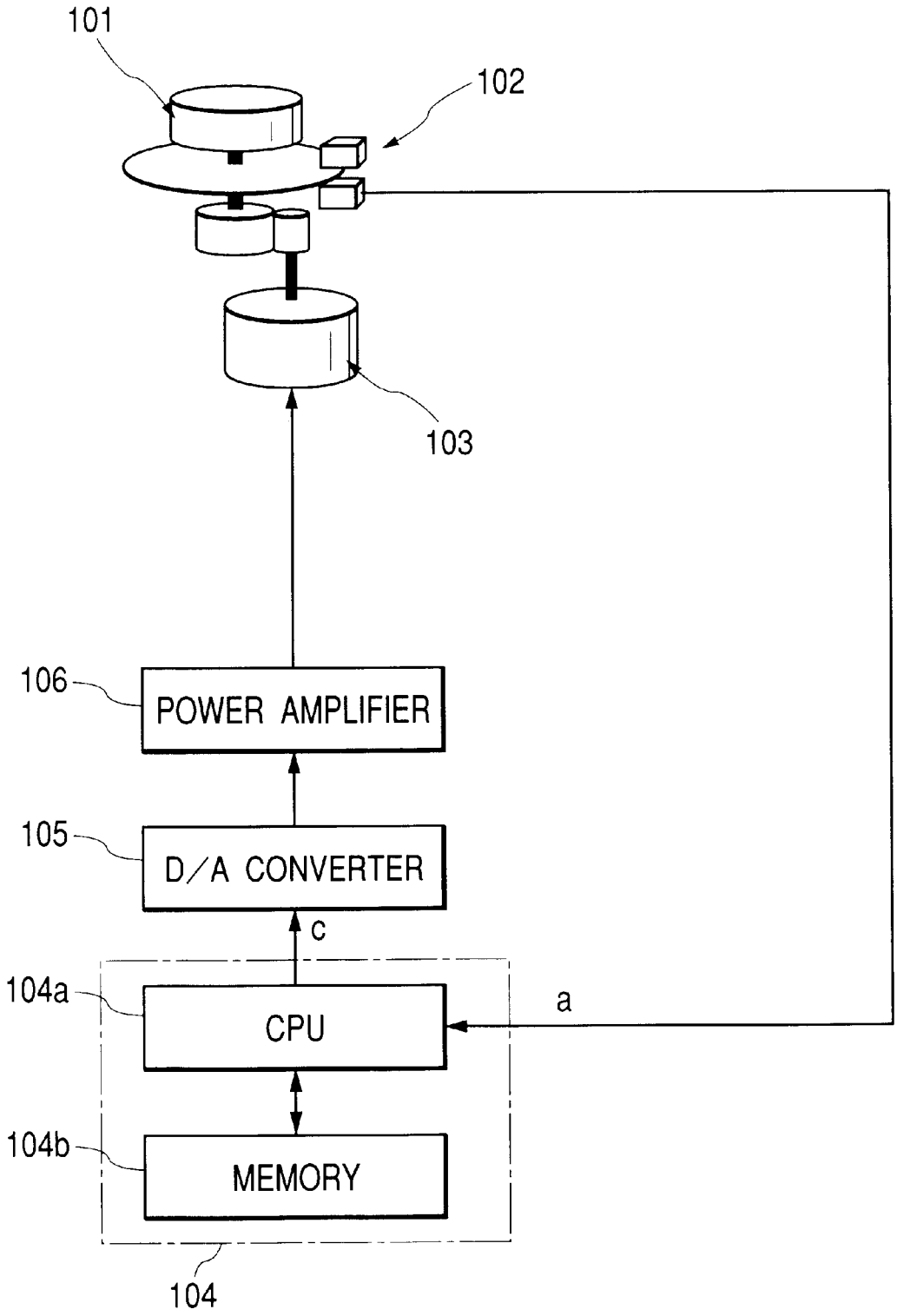
FIG. 12 PRIOR ART
FIG. 12 illustrates the configuration of a manual input device according to the prior art.

Next will be described an example of vehicle-mounted device control unit pertaining to the present invention with reference to FIG. 9 through FIG. 11. FIG. 9 is a perspective view of essential parts showing how the vehicle-mounted device control unit embodying the invention is fitted to the dashboard; FIG. 10, a plan of essential parts showing the interior state of a vehicle fitted with the vehicle-mounted device control unit embodying the invention; and FIG. 11, a functional block diagram of the vehicle-mounted device control unit embodying the invention.

As is evident from FIG. 9, in a vehicle-mounted device control unit 51 embodying the invention in this mode, a case 52 is formed in a rectangular container shape of a required size, and the manual input device 1A embodying the invention is built into the case 52, over which are arranged the joystick type knob 2 and the rotary knob 3 provided for the manual input device 1A and the clutch change-over switch 19. Also arranged on the top face of the case 52 are six push-button switches 54*a*, 54*b*, 54*c*, 54*d*, 54*e* and 54*f* in an arc shape around the setting section of the knob 3. In the front face of the case 52 are opened a card slot 57 and a disk slot 58. Sign D in the drawing denotes a display unit.

This vehicle-mounted device control unit, as shown in FIG. 10, is fitted on the dashboard A of the vehicle between the driver's seat B and the front passenger seat C.

The six push-button switches 54*a* through 54*f* arranged in an arc shape are electric appliance selection switches for selecting one or another of the vehicle-mounted electric appliances to be operated by using the vehicle-mounted device control unit 51 embodying the invention, including for instance the air conditioner, radio, television, CD player, car navigation system, steering wheel tilting device, seat posture adjusting device, telephone, voice recognition and gear shift, and they are individually connected to the vehicle-mounted electric appliances. Whereas the pairing of a push-button switch and a vehicle-mounted electric appliance can be set as desired, in this example of vehicle-mounted device control unit 51, as shown in FIG. 11, the push-button switch 54*a* is connected to the air conditioner, the push-button switch 54*b* to the radio, the push-button switch 54*c* to the television, the push-button switch 54*d* to the CD player, the push-button switch 54*e* to the car navigation system, and the push-button switch 54*f* to the steering wheel tilting device. By pressing the knob of a desired push-button switch, the vehicle-mounted electric appliance connected to the push-button switch can be selected.

The manual input device 1A built into the case 52 is the functional adjustment means for the vehicle-mounted electric appliance selected with the pertinent one of the push-button switches 54*a* through 54*f*. Where the air conditioner is selected with the push-button switch 54*a* for instance, a desired one out of the front defroster, rear defogger, temperature adjustment and air flow rate adjustment can be selected by manipulating the joystick type knob 2, and the temperature or air flow rate of the air conditioner can be adjusted by manipulating the joystick type knob 2 or the rotary knob 3. The methods of selecting a function and adjusting the temperature and air flow rate of the air conditioner using the joystick type knob 2 and the rotary knob 3, together with the force feedback control the joystick type knob 2 and the rotary knob 3 accomplished in that connection, have already been described with reference to the manual input device embodying the invention, and therefore the description will not be duplicated here.

Although the selection of the desired vehicle-mounted electric appliance is accomplished with push-button switches 54*a* through 54*f*, the desired function of the selected vehicle-mounted electric appliance is accomplished with the joystick type knob 2 and the adjustment of the selected function of the vehicle-mounted electric appliance is accomplished with the joystick type knob 2 or the rotary knob 3 in this example, it is also possible to replace this configuration with another in which functional selection switches for vehicle-mounted electric appliances are provided in part of the case 52 constituting the vehicle-mounted device control unit 51 and the joystick type knob 2 and the rotary knob 3 are used only for adjusting the functions of the appliances.

Since the vehicle-mounted device control unit embodying the invention is thus able to centrally control the plurality of vehicle-mounted electric appliances, the function of each vehicle-mounted electric appliance can be readily accomplished, making it possible to enhance the safety of vehicle driving. Further, as what is provided with a plurality of knobs is used as the manual input device, the plurality of knobs can be differentiated in use according to the type or function of the electric appliance to be adjusted, the vehicle-mounted device control unit can be improved in operatability and multifunctionalized.

Since the manual input device according to the invention is equipped with a plurality of knobs, the plurality of knobs can be used in a differentiated manner according to the device or the function to be adjusted, resulting in improved operatability and multifunctionalization of the manual input device. The concentric arrangement of the plurality of knobs makes possible consolidation of knob installation spaces and accordingly a reduction in the size of the manual input device. Furthermore, as the configuration is such that an external force for force feedback is selectively loaded from a single force feedback actuator onto each knob via a required power transmission mechanism, the configuration of the manual input device can be made more compact than where a force feedback actuator is provided for each knob, resulting in reductions in size and cost of the manual input device and accordingly in power saving.

Since the vehicle-mounted device control unit is equipped with electric appliance selection switches for selecting the electric appliance whose functions are to be adjusted and a manual input device for adjusting the function selected by the functional selection switch, a single vehicle-mounted device control unit can centrally accomplish functional adjustment of many electric appliances, thereby facilitating the functional adjustment of various vehicle-mounted electric appliances and enhance the safe drive performance of the vehicle. Further, as the vehicle-mounted device control unit is provided with a manual input device having a plurality of knobs, it is possible to use the plurality of knobs in a differentiated manner according to the device or the function to be adjusted, resulting in improved operatability and multifunctionalization of the vehicle-mounted device control unit. Moreover, the concentric arrangement of the plurality of knobs makes possible consolidation of knob installation spaces and accordingly a reduction in the size of the vehicle-mounted device control unit. Furthermore, as the configuration is such that an external force for force feedback is selectively loaded from a single force feedback actuator onto each knob via a required power transmission mechanism, the configuration of the vehicle-mounted device control unit can be made more compact than where a force feedback actuator is provided for each knob, resulting in reductions in size and cost of the vehicle-mounted device control unit and accordingly in power saving.

What is claimed is:

1. A manual input device comprising:

a plurality of concentrically arranged knobs;

one force feedback actuator to load the plurality of knobs with an external force;

a plurality of power transmission mechanisms, connected between the plurality of knobs and the force feedback actuator, to individually transmit drive power supplied from the force feedback actuator to the plurality of knobs; and a plurality of detectors to individually detect manipulated states of the plurality of knobs.

2. The manual input device according to claim 1, wherein a joystick type knob and a rotary knob are concentrically provided as the plurality of knobs.

3. The manual input device according to claim 1, wherein each of the power transmission mechanisms is provided with a clutch, a clutch change-over switch and a clutch change-over actuator operated with the switch.

4. The manual input device according to claim 1, wherein a control unit to control the force feedback actuator in accordance with a signal from the plurality of detectors is integrally provided within a case constituting the manual input device.

5. The manual input device according to claim 1, wherein a control unit to control the force feedback actuator in accordance with a signal from the plurality of detectors is provided in an external device operated with the plurality of knobs.

6. The manual input device according to claim 1, having, as the plurality of power transmission mechanisms, at least a first power transmission mechanism to transmit drive power from the force feedback actuator provided for one of the plurality of knobs; a second power transmission mechanism to transmit drive power from the force feedback actuator provided for another of the plurality of knobs; a first clutch plate fitted to a drive shaft of the force feedback actuator to be slidable in an axial direction; and a clutch change-over actuator to slide the first clutch plate, wherein the first power transmission mechanism is provided with a second clutch plate coupleable to the first clutch plate, wherein the second power transmission mechanism is provided with a third clutch plate coupleable to the first clutch plate, and wherein the coupling between the first clutch plate and one of the second clutch plate and the third clutch plate is changed over by having the clutch change-over actuator slide the first clutch plate.

7. The manual input device according to claim 6, wherein one of the plurality of knobs is a joystick type knob and another of the plurality of knobs is a rotary knob.

8. The manual input device according to claim 1, wherein the joystick type knob and the rotary knob are concentrically disposed.

9. A vehicle-mounted device control unit having an electric appliance selection switch to select an electric appliance whose function is to be adjusted and a manual input device to adjust a function possessed by the electric appliance selected by the selection switch, wherein the manual input device has a plurality of knobs arranged concentrically, one force feedback actuator to load external forces onto the plurality of knobs, a plurality of power transmission mechanisms, connected between the plurality of knobs and the force feedback actuator, to individually transmit drive power supplied from the force feedback actuator to each of the plurality of knobs, and a plurality of detectors to individually detect manipulated states of the plurality of knobs.

* * * * *